US009772113B2

(12) United States Patent
Moore et al.

(10) Patent No.: US 9,772,113 B2
(45) Date of Patent: Sep. 26, 2017

(54) APPARATUS AND METHODS FOR TEMPORARILY HOLDING THE EVAPORATOR/FAN UNIT OF A DUCTLESS MINI-SPLIT HVAC SYSTEM PROXIMATE TO A WALL

(71) Applicant: Rectorseal, LLC, Houston, TX (US)

(72) Inventors: Michael A Moore, Swansea, MA (US); Zheng-Yi Xu, Houston, TX (US); Robert Alan Martinelli, Katy, TX (US)

(73) Assignee: Rectorseal, LLC, Houston, TX (US)

( * ) Notice: Subject to any disclaimer, the term of this patent is extended or adjusted under 35 U.S.C. 154(b) by 373 days.

(21) Appl. No.: 14/513,605

(22) Filed: Oct. 14, 2014

(65) Prior Publication Data

US 2015/0107277 A1 Apr. 23, 2015

Related U.S. Application Data

(60) Provisional application No. 61/961,698, filed on Oct. 21, 2013.

(51) Int. Cl.
*F24F 1/02* (2011.01)
*F24F 13/32* (2006.01)

(52) U.S. Cl.
CPC ..... *F24F 1/027* (2013.01); *F24F 13/32* (2013.01)

(58) Field of Classification Search
CPC ..... F24F 1/027; F24F 13/32; A47B 96/06; A47B 96/061; A47B 96/068; A47B 96/07; A47B 5/04; A47B 57/045
USPC ..... 248/235, 240, 241, 242, 247, 236; 62/262
See application file for complete search history.

(56) References Cited

U.S. PATENT DOCUMENTS 557,875 A * 4/1896 Pittet ..... E06B 7/28 248/236
1,325,229 A * 12/1919 Braund ..... A47L 3/02 182/113
1,512,792 A 10/1924 Nelson
1,894,878 A * 1/1933 La Grange ..... A47L 3/02 182/152
2,420,635 A * 5/1947 Workman ..... A47L 3/02 182/61
2,717,139 A 9/1955 Jewell
(Continued)

FOREIGN PATENT DOCUMENTS

EP 1150075 A1 10/2001
EP 1193453 A1 4/2002
(Continued)

*Primary Examiner* — Anita M King
(74) *Attorney, Agent, or Firm* — Marc L. Delflache; Jones Delflache LLP

(57) ABSTRACT

A portable and reusable installation platform for easing the installation or maintenance of an air conditioner on a vertical wall includes at least one support base upon which at least part of the air conditioner is positioned during the installation or maintenance thereof. At least one connector extends from the first end of the support base and is configured to releasably engage the wall. At least one support leg extends downwardly from the support base and is configured to abut the wall to support the weight of the air conditioner placed upon the support base.

9 Claims, 3 Drawing Sheets

(56) References Cited

U.S. PATENT DOCUMENTS

| | | | | | |
|---|---|---|---|---|---|
| 2,880,952 | A * | 4/1959 | Moore | F24F 1/04 | 126/333 |
| 2,935,284 | A | 5/1960 | Reeves | | |
| 3,394,910 | A * | 7/1968 | Ulich | F24F 13/00 | 248/208 |
| D288,570 | S * | 3/1987 | Fonceca | 248/300 | |
| 5,636,816 | A * | 6/1997 | Burton | F24F 13/32 | 248/208 |
| 8,091,844 | B1 * | 1/2012 | Bragg | F24F 13/32 | 248/208 |
| 8,533,955 | B2 * | 9/2013 | Agnihotri | F16M 11/10 | 248/208 |
| 8,584,998 | B1 * | 11/2013 | Peterson | F24F 13/32 | 182/62 |
| 9,163,854 | B2 * | 10/2015 | Arbucci | E06B 7/28 | |
| 9,303,895 | B1 * | 4/2016 | Grant | F24F 13/32 | |
| 9,605,870 | B2 * | 3/2017 | Darby | F16M 13/022 | |

FOREIGN PATENT DOCUMENTS

| | | | |
|---|---|---|---|
| WO | 03016790 | A1 | 2/2003 |
| WO | 2011085676 | A1 | 7/2011 |

* cited by examiner

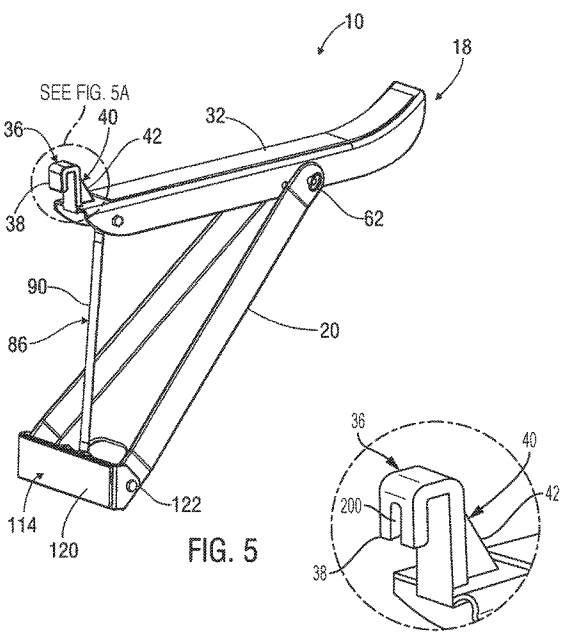
FIG. 5
FIG. 5A
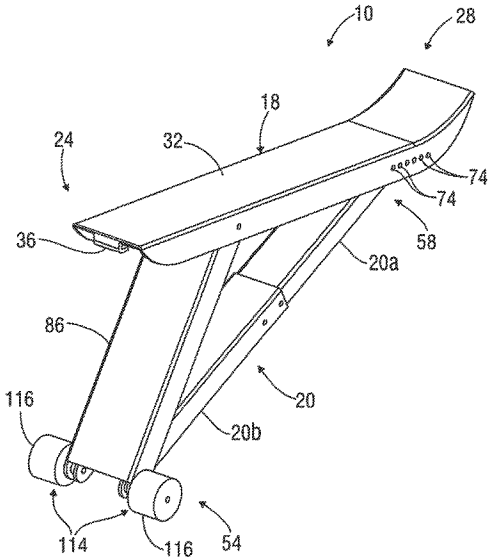
FIG. 4

APPARATUS AND METHODS FOR TEMPORARILY HOLDING THE EVAPORATOR/FAN UNIT OF A DUCTLESS MINI-SPLIT HVAC SYSTEM PROXIMATE TO A WALL

CROSS REFERENCE TO RELATED APPLICATIONS

This application claims priority to U.S. Provisional Patent Application Ser. No. 61/961,698 filed on Oct. 21, 2013 and entitled "Portable Platforms for Installing a Mini-Split HVAC System", the entire contents of which are hereby incorporated by reference herein in their entirety.

FIELD OF THE INVENTION

The present disclosure relates generally to HVAC systems, and more particularly, to ductless mini-split HVAC systems.

BACKGROUND OF THE INVENTION

Ductless mini-split HVAC systems typically include an outdoor compressor unit and an indoor evaporator/fan unit and do not require a central system of ductwork. The outdoor and indoor units are usually connected by one or more conduits that contain electrical wiring, refrigerant lines and condensate tubing. The evaporator/fan unit often fits inside a slim case that mounts within the room or area to be air conditioned and may be ceiling, or wall, mounted.

A typical ductless mini-split HVAC system is controlled with a thermostat. When the temperature in the room exceeds a set-point of the thermostat, the outside compressor is automatically switched on. Refrigerant gas will be squeezed through a network of pipes and orifices in the compressor to raise its temperature and pressure. The refrigerant gas then moves into the condenser of the compressor, where a fan extracts heat from the refrigerant and exhausts it to the outside. When excess heat is removed, the refrigerant is transformed into a cool liquid. This cool liquid travels into the home through one or more tubes connecting the compressor and evaporator/fan unit.

As the cool liquid refrigerant enters the building, it typically passes through an expansion valve and undergoes an abrupt reduction in pressure. The reduction in pressure will dramatically flash-evaporate part of the liquid refrigerant, lowering the temperature of the liquid/vapor mix. A fan unit within the evaporator/fan unit will draw warm air from inside the room into the evaporator/fan unit. The warm air is exposed to the cool refrigerant passing through evaporator/fan unit coils or tubes, which absorbs excess heat from the air and thus cools down the room. The refrigerant with the excess heat from the room is then transferred back to the outside compressor and the cycle repeats.

The evaporator/fan unit is typically mounted on the interior wall of a room to be cooled or heated, and, thus, appearance is often important. In many instances, the evaporator/fan unit is hung flush with the wall and the refrigerant, electrical and condensate lines are run behind the wall (e.g. behind wall board) or against the wall and hidden (e.g. with decorative covers). Installing a mini-split evaporator/fan unit flush against an interior wall is often difficult and may require multiple installers. For example, a first person is often required to connect the refrigerant, electrical and condensate lines, while a second person holds the evaporator/fan unit spaced away from the wall. This operation can be especially challenging in certain situations, such as when the evaporator/fan unit is mounted high on a wall, requiring both installers to be positioned upon ladders.

After the refrigerant and electrical connections are made, the evaporator/fan unit can be positioned flush against the wall and then attached thereto (e.g. using a bracket). Thereafter, access to the evaporator/fan unit and/or refrigerant and electrical lines, such as for maintenance, repair or inspection (e.g. fixing a condensate pump or other important component in the interior of the evaporator/fan unit) may be challenging because the evaporator/fan unit must be moved away from the wall. As with installation, this often also requires multiple personnel (e.g. one to hold the evaporator/fan unit and another to perform work between the unit and the wall).

Accordingly, there exists a need for improved systems, apparatus and methods useful to assist in temporarily holding the evaporator/fan unit of a ductless mini-split HVAC system proximate to a wall, such as for installation, maintenance, etc. having one or more of the features, attributes or capabilities described or shown in, or as may be apparent from, the various portions of this patent.

It should be understood that the above-described discussion is provided for illustrative purposes only and is not intended to limit the scope or subject matter of the appended claims or those of any related patent application or patent. Thus, none of the appended claims or claims of any related application or patent should be limited by the above discussion or construed to address, include or exclude each or any of the cited examples, features and/or disadvantages, merely because of the mention thereof herein.

BRIEF SUMMARY OF THE DISCLOSURE

In some embodiments, the present disclosure involves apparatus for temporarily positioning the evaporator/fan unit of a mini-split HVAC unit proximate to a wall. The apparatus includes a removable, reusable platform that has an upper, horizontally-oriented, elongated support base. The support base has a first end configured to be positioned adjacent to the wall during use of the platform and a second end configured to be spaced away from the wall during use of the platform. The support base also has an upwardly facing support surface extending at least partially between the first and second ends and upon which at least part of the evaporator/fan unit is positioned and supported during use of the platform. At least one connector is disposed proximate to the first end of the support base and configured to releasably connect the platform to the wall or, in some embodiments, to one or more component attached to the wall, such as for example, a "mini-split wall mounting plate". As used herein, reference to connection or engagement of the platform (or other component) to the wall thus means directly or indirectly (through one or more other component) connected to the wall. The platform also includes an elongated support leg having first and second ends. The second end of the support leg is pivotably connected to the support base between the midpoint of the support base and the second end thereof so that the support leg is pivotable relative to the support base between at least a first, collapsed position and at least a second, extended position. The first end of the support leg in the first, collapsed position is positioned proximate to the first end of the support base. The first end of the support leg in the second, extended position is spaced downwardly from the first end of the support base and engageable with the wall.

In many embodiments, the present disclosure involves a system useful for temporarily positioning the evaporator/fan unit of a mini-split HVAC unit proximate to a wall. The system includes at least two removable, reusable platforms. Each platform includes an upper, horizontally-oriented, elongated support base upon which at least part of the evaporator/fan unit is positioned and supported during use of the platform. An elongated support leg extends from the support base. The support leg is configured to collapse toward the support base when the platform is not in use, and be moveable into a downwardly, angularly-oriented position relative to the support base to abut the wall when the platform is in use. At least one spacer extends between the support base and the support leg and is configured to limit the downward movement of the support leg relative to the support base.

In various embodiments, the present disclosure involves a portable and reusable installation platform for easing the installation or maintenance of an air conditioner on a vertical wall. The platform includes at least one elongated support base upon which at least part of the air conditioner is positioned during the installation or maintenance thereof. The support base includes first and second ends. At least one connector extends from the first end of the support base and is configured to releasably engage the wall. At least one support leg extends downwardly from the support base and is configured to abut the wall to support the weight of the air conditioner placed upon the support base.

The present disclosure also includes embodiments of a method of temporarily positioning the evaporator/fan unit of a mini-split HVAC unit proximate to a wall with the use of at least one positioning platform to allow one or more refrigerant, electrical or condensate lines to be connected to the evaporator/fan unit, or to allow maintenance of the evaporator/fan unit. The method includes releasably engaging at least one connector extending from a first end of an elongated, horizontally-oriented support base of the platform with the wall. A support leg of the platform is pivoted downwardly from the support base until the first end thereof abuts the wall. The evaporator/fan unit is placed upon an upwardly facing support surface of the support base so that it is spaced away from the wall to allow one or more refrigerant, electrical or condensate lines to be connected to the evaporator/fan unit, or to allow maintenance of evaporator/fan unit.

Accordingly, the present disclosure includes features and advantages which are believed to enable it to advance ductless mini-split HVAC system technology. Characteristics and advantages of the present disclosure described above and additional features and benefits will be readily apparent to those skilled in the art upon consideration of the following detailed description of various embodiments and referring to the accompanying drawings.

BRIEF DESCRIPTION OF THE DRAWINGS

The following figures are part of the present specification, included to demonstrate certain aspects of various embodiments of this disclosure and referenced in the detailed description herein:

FIG. 4 is a perspective view an embodiment of a positioning platform having a telescoping support leg in accordance with the present disclosure;

FIG. 5 is a perspective view another embodiment of a positioning platform in accordance with the present disclosure;

FIG. 5A is a detail taken from FIG. 5;

DETAILED DESCRIPTION OF PREFERRED EMBODIMENTS

Figures 1A, 1B, 2, 3:
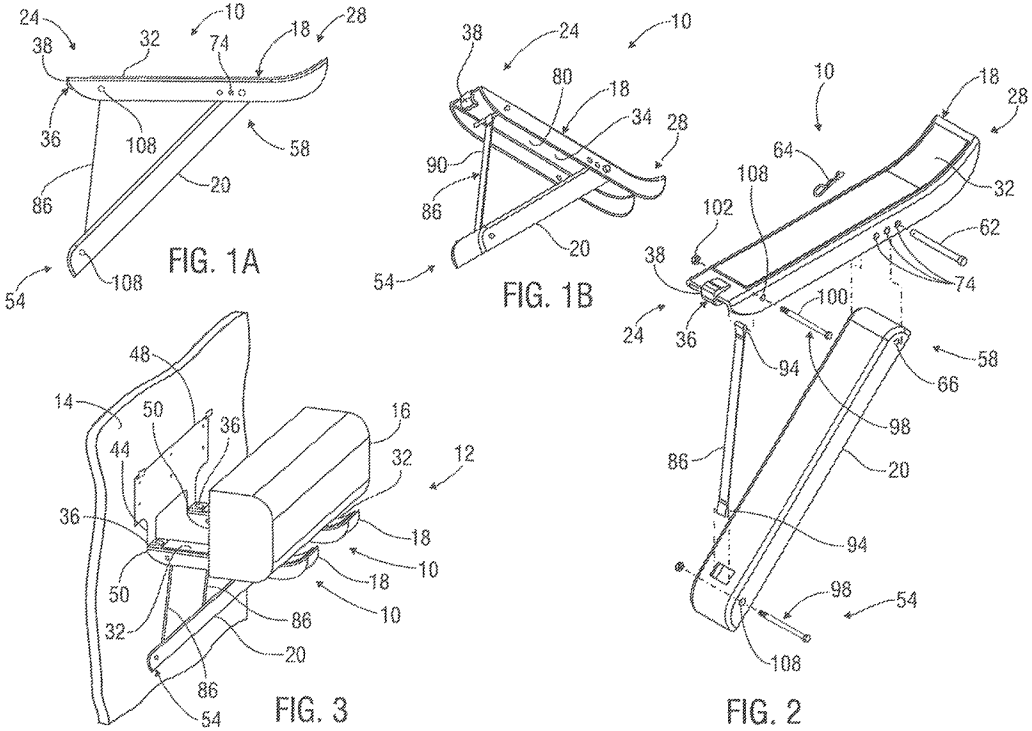
FIG. 1A is a side view of an embodiment of a positioning platform in accordance with the present disclosure.
FIG. 1B is a perspective view of the exemplary platform shown in FIG. 1A.
FIG. 2 is an assembly drawing of the exemplary platform shown in FIG. 1A.
FIG. 3 is a perspective view of an embodiment of a positioning system having two exemplary platforms shown temporarily mounted to a wall and supporting the evaporator/fan unit of a ductless mini-split HVAC system in accordance with the present disclosure.

Characteristics and advantages of the present disclosure and additional features and benefits will be readily apparent to those skilled in the art upon consideration of the following detailed description of exemplary embodiments and referring to the accompanying figures. It should be understood that the description herein and appended drawings, being of example embodiments, are not intended to limit the claims of this patent or any patent or patent application claiming priority hereto. On the contrary, the intention is to cover all modifications, equivalents and alternatives falling within the spirit and scope of the claims. Many changes may be made to the particular embodiments and details disclosed herein without departing from such spirit and scope.

In showing and describing preferred embodiments, common or similar elements are referenced with like or identical reference numerals or are apparent from the appended figures and/or the description herein. When multiple figures refer to a component or feature with the same reference numeral, any description herein of the component or feature with respect to any of the figures applies equally to the other figures to the extent such description does not conflict with a description herein of the other figure(s). The figures are not necessarily to scale and certain features and certain views of the figures may be shown exaggerated in scale or in schematic in the interest of clarity and conciseness.

As used herein and throughout various portions (and headings) of this patent, the terms "invention", "present invention" and variations thereof are not intended to mean every possible embodiment encompassed by this disclosure or any particular claim(s). Thus, the subject matter of each such reference should not be considered as necessary for, or part of, every embodiment hereof or of any particular claim(s) merely because of such reference. The terms "coupled", "connected", "engaged" and the like, and variations thereof, as used herein and in the appended claims are intended to mean either an indirect or direct connection or engagement. Thus, if a first device couples to a second device, that connection may be through a direct connection, or through an indirect connection via other devices and connections.

Certain terms are used herein and in the appended claims to refer to particular components. As one skilled in the art will appreciate, different persons may refer to a component by different names. This document does not intend to distinguish between components that differ in name but not function. Also, the terms "including" and "comprising" are used herein and in the appended claims in an open-ended fashion, and thus should be interpreted to mean "including, but not limited to . . . . " Further, reference herein and in the appended claims to components and aspects in a singular tense does not necessarily limit the present disclosure or appended claims to only one such component or aspect, but should be interpreted generally to mean one or more, as may be suitable and desirable in each particular instance.

Referring initially to FIGS. 1A & 1B, an embodiment of a positioning platform 10 useful for temporarily holding the evaporator/fan unit (e.g. unit 16, FIG. 3) of a ductless mini-split HVAC system proximate to a wall (e.g. wall 14, FIG. 3) is shown. The wall is typically generally vertically-oriented, but may be non-vertical. The ductless mini-split HVAC system is known in the art. The platform 10 may be useful for any suitable purpose, such as, for example, during installation maintenance, repair or inspection of the evaporator/fan unit or related components and to improve the efficiency (e.g. time, manpower, expense, etc.) of such processes. However, the present disclosure is not limited use of the platform 10 for these particular purposes.

The exemplary platform 10 is removable and reusable, and includes an upper, generally horizontally-orientable support base 18 and at least one support leg 20. The support base 18 and support leg 20 may have any suitable configuration, form and operation. In this example, the support base 18 and support leg 20 are elongated. As used herein, the term "elongated" means a component having a length that is greater than its width. However, in other embodiments, the support base 18 and/or support leg 20 may not be elongated. The illustrated support base 18 is configured to support at least part of the evaporator/fan unit prior to, during and/or after installation of the evaporator/fan unit. In this example, the support base 18 includes a first end 24 configured to be positioned adjacent to the wall (e.g. wall 14, FIG. 3) during use of the platform 10, and a second end 28 configured to be spaced away from the wall during use of the platform 10.

Still referring to Figures 1A & 1B, the illustrated support base 18 also includes an upwardly facing support surface 32 (See FIG. 2) and at least one connector 36. The exemplary support surface 32 extends at least partially between the first and second ends 24, 28 of the support base 18, and is configured to hold, or support, at least part of the evaporator/fan unit 16 during use of the platform 10 (See e.g. FIG. 3). The illustrated connector 36 is disposed proximate to the first end 24 of the support base 18 and configured to releasably connect the platform 10 to the wall (e.g. wall 14, FIG. 3), or one or more components mounted on the wall. The connector 36 may have any suitable form, configuration and operation. For example, the illustrated connector 36 extends below the support surface 32. In FIGS. 2, 5, 6A & 7A, the connector 36 extends above the support surface 32. For another example, the connector 36 may include at least one hook 38. The illustrated hook 38 is downwardly facing (FIG. 1B), but could instead be upwardly facing (e.g. FIGS. 2, 5, 6A & 7A). If desired, a back 40 (e.g. FIG. 5) may be provided behind the connector 36, such as to provide strength or support to the connector 36, assist in allowing the platform 10 to be easily removed after use thereof or any other desired purpose. In FIG. 5, the back 40 takes the form of a wedge 42, but could have any other suitable form and configuration. Referring to FIG. 5A, if desired, the hook 38 may include a channel 201 that allows the hook 38 to be slipped over a screw head, nail head or other protrusion extending outwardly from the wall or a component mounted on the wall.

The connector 36 is releasably engageable with the wall (or one or more components mounted on the wall) in any suitable manner. For example, the connector 36 may engage hardware extending from or mounted on the wall. In the embodiment of FIG. 3, the illustrated connector 36 engages a bracket 44 disposed at the bottom of a mini-split wall mounting plate 48 that is engaged with the wall 14. For another example, the connector 36 may engage a bracket (not shown) inserted into dry wall, a wall stud, etc. It should be understood, however, that the present disclosure is not limited by the technique or components for engaging the connector 36 with the wall 14. As used herein, the term "bracket" means one or more coupling mechanism that can be engaged by the connector 36 and having any desired, form, configuration and operation, such as, without limitation, one or more holes, slots, pressure fittings and male/female connectors.

In some embodiments, the second end 28 of the support base 18 may, if desired, have an upwardly-oriented, ramp-like shape, such as shown in FIGS. 1-3, such as to prevent the evaporator/fan unit (e.g. unit 16, FIG. 3) from falling or sliding off the second end 28 of the support base 18 or other desired purpose. In various embodiments, the support base 18 may also or instead include one or more vertically-oriented side member (not shown) extending upwardly relative to the support surface 32 on at least one side thereof, such as such as to prevent the evaporator/fan unit (e.g. unit 16, FIG. 3) from sliding or falling off one or more side of the support base 18. Further, the vertically-oriented side member may be pivotable relative to the support base 18, so that it can fold down onto or proximate to the support surface 32 during non-use of the platform 10 (e.g. storage and transportation).

Referring back to the embodiment of FIGS. 1A & 1B, the illustrated support leg 20 includes first and second ends 54, 58. The second end 58 of the exemplary support leg 20 is pivotably connected to the support base 18 as desired, such as at some location between the midpoint of the base 18 and its second end 28, so that the support leg 20 is pivotable thereabouts between at least a first, collapsed position (not shown) and at least a second, extended position. In the first, collapsed position, the support leg 20 is essentially folded toward the support base 18. For example, the first end 54 of exemplary support leg 20 may be positioned generally proximate to the first end 24 of the support base 18. Positioning of the support leg 20 in the first collapsed position may be useful, for example, during non-use of the platform 10 (e.g. storage, transportation, etc.). In the second, extended, position, the first end 54 of the illustrated support leg 20 is spaced downwardly from the first end 24 of the support base 18 and engageable with the wall (e.g. wall 14, FIG. 3), or one or more components mounted on the wall. Positioning the support leg 20 in the second extended position may be useful, for example, to support the support base 18 and the evaporator/fan unit (e.g. unit 16, FIG. 3) positioned thereupon during use of the platform 10.

Referring to FIG. 2, the second end 58 of the exemplary support leg 20 may be pivotably connected to the support base 18 in any suitable manner. For example, a pivot pin 62 may be used to pivotably connect the support leg 20 and the support base 18. In this embodiment, the pin 62 extends through a hole 66 formed in the support leg 20 and an aligned hole 74 formed in the support base 18. The pin 62 may be held in place in any suitable manner, such as with a clip 64. If desired, the pin 62 may have multiple optional positions, such as to allow the angle of orientation support leg 20 in an extended position to be changed. For example, multiple anchor holes 74 may be formed in the support base 18 for receiving the pin 62, each hole 74 providing a different angle of orientation of the support leg 20. This may be useful for any desired purpose, such as when it is desirable to position the evaporator/fan unit on the platform 10 at a non-horizontal angle or if the wall is not perfectly vertical.

Referring back to FIG. 1B, if desired, the support base 18 may have at least one hollow 80 extending at least partially along the bottom side 34 thereof. The hollow 80 may have any desired configuration, form and operation. In this example, the hollow 80 is sized and shaped to accept the support leg 20 in its first, collapsed position. This "nesting" of the support leg 20 in the support base 18 may, for example, allow for ease of storage and transportation of the reusable platform 10. In some embodiments, the support leg 20 may be snap-fit into the hollow 80. However, in other embodiments, the support leg 20 will not nest inside the support base 18.

Figure 7A:
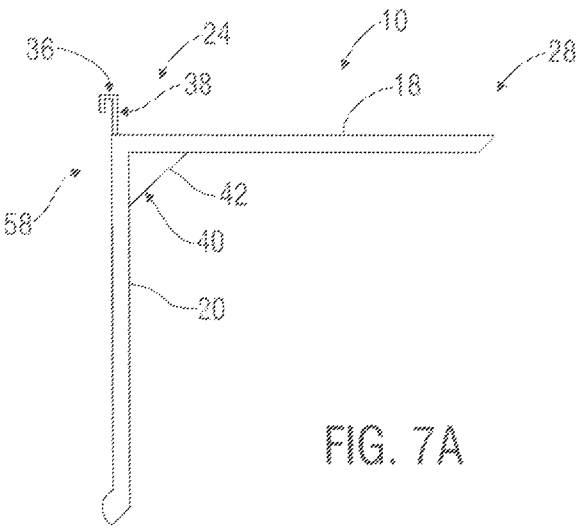
FIG. 7A is a side view of an embodiment of a positioning platform having a rigid support leg in accordance with the present disclosure.
Figure 7B:
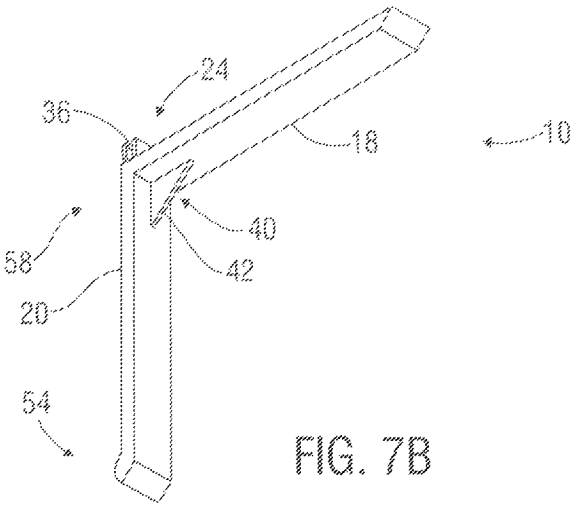
FIG. 7B is a perspective view of the exemplary platform shown in FIG. 7A.

Referring now to FIGS. 7A & 7B, the support leg 20 may instead be rigidly or permanently engaged with the support base 18. In this embodiment, the support leg 20 extends roughly perpendicular to the support base 18 so that the platform 10 is fixed in a generally L-shape. In other embodiments, the platform 10 may be similarly fixed in a V-shape or other desired configuration. If desired, a back 40 may be provided at the intersection of the first end 24 of the support base 18 and the second end 58 of the support leg 20, such as to add strength to the platform 10 or other desired purpose. The back 40 may have any suitable form, shape, configuration and operation. In this embodiment, the back 40 is a wedge 42.

The support base 18 and support leg 20 may be constructed of any suitable material, such as plastic, metal, wood or a combination thereof, to provide sufficient stiffness and strength to temporarily, safely and securely support or hold at least part of the evaporator/fan unit (e.g. unit 16, FIG. 3) during use of the platform 10.

Referring back to FIGS. 1A & 1B, if desired, the platform 10 may include at least one spacer 86 useful to prevent the support leg 20 from pivoting too far away from the support base 18, or to establish a lowermost position of the first end 54 of the support leg 20 in its second, extended position. The spacer 86 may have any suitable configuration, form and operation. In some embodiments, the spacer 86 may be flexible. For example, the illustrated spacer 86 is a strap 90, but could be a rope or other non-rigid member. In other embodiments, the spacer 86 may be rigid. In those instances, the upper end of the spacer 86 may be configured to slide along the bottom side 34 of the support base 18 to allow the support leg 20 to pivot as it moves between positions.

Figure 6A:
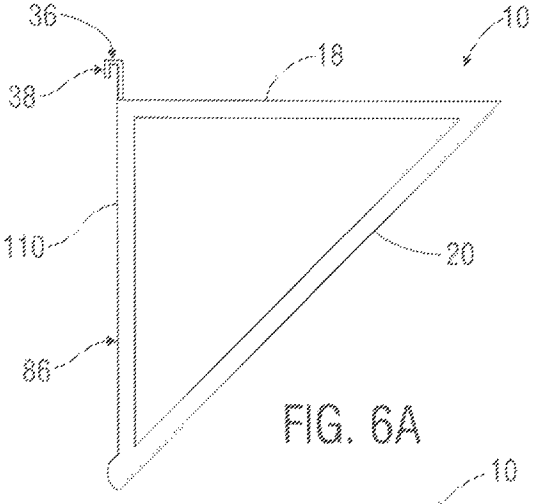
FIG. 6A is a side view of an embodiment of a positioning platform having a rigid spacer extending between its support base and support leg in accordance with the present disclosure.
Figure 6B:
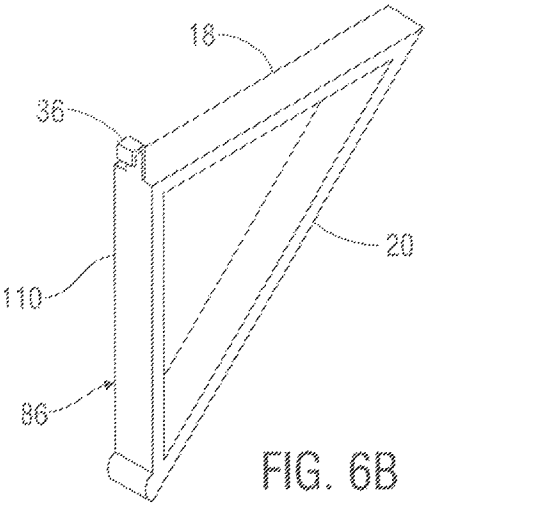
FIG. 6B is a perspective view of the exemplary platform shown in FIG. 6A.

The spacer 86 may be engaged with the support base 18 and support leg 20 in any suitable manner. Referring to FIG. 2, in some embodiments, the spacer 86 may be secured in place with couplers 98. The couplers 98 may have any suitable form, configuration and operation. In this embodiment, for example, each coupler 98 is a bolt 100 secured with a nut 102. For another example, the coupler 98 may be a pin secured with a clip, similar to pivot pin 62 and clip 64. The illustrated couplers 98 extend through passageways 94 formed in each end of the spacer 86 and aligned corresponding holes 108 (or pairs thereof) formed in the support base 18 and support leg 20, respectively. In other embodiments, such as shown in FIGS. 6A & 6B, the spacer 86 may be a rigid member 110 (e.g. bar, pipe, etc.), rigidly secured to the support base 18 and support leg 20. In FIGS. 6A & 6B, the support leg 20 is fixed in position (non-movable) and the platform 10 takes a triangular or similar shape.

Referring back to FIG. 3, it may be desirable to use a positioning system 12 that includes at least two platforms 10 for temporarily positioning or holding the evaporator/fan unit 16 of a mini-split HVAC unit proximate to a wall 14. The first and second platforms 10 are each releasably coupled to the wall 14 in any suitable manner. In this embodiment, two lower brackets 44 of the illustrated wall mounting plate 48 (previously coupled to the wall 14) each includes a lower slot of a snap-in tab 50 designed to normally engage the bottom of the evaporator/fan unit 16. However, these slots are shown being temporarily used to engage the connectors 36 of the respective platform support bases 18 to anchor the platforms 10 to the wall 14. In other embodiments, the connector 36 may instead engage other mounting slots (not shown) attached to wall board or studs, or any other suitable hardware or anchor points.

As shown, the first end 54 of each exemplary support leg 20 is positioned to engage (rest against) the wall 14 to help stabilize and support the weight of the evaporator/fan unit 16 on the support base 18. The exemplary evaporator/fan unit 16 is placed and supported on the support surface 32 of each illustrated platform 10 and positioned proximate to the wall 14 (prior to its engagement with the mounting plate 48). While FIG. 3 illustrates the use of two platforms 10, the system 12 may include any other suitable number of platforms 10, such as one three, four or more.

In the illustrated embodiment, the portable and reusable platforms 10 are designed to attach to the wall 14 at the bottom portion of the plate 48, which is just below the area where the evaporator/fan unit 16 will be/was mounted. However, the platforms 10 could be releasably engaged with the wall 14 in any other suitable location or arrangement. The exemplary support leg 20 is pivoted downward so that it is in a diagonal position with its first end 54 resting against the wall 14. In some configurations, the platform 10 includes a spacer 86 to ensure that the support leg 20 does not pivot farther than desired. Other configurations may not include a spacer 86, such as with the use of a stop member (not shown) that will limit pivoting of the support leg 20 or when a rigid, non-pivoting, support leg 20 is used.

In this example, with the support bases 18 in a roughly horizontal position and the support legs 20 opened and resting against the wall in a diagonal position, the platforms 10 are stable and the evaporator/fan unit 16 may be placed on the support surfaces 32 of the platforms 10 in a suitable position for hooking up accessories (e.g. pumps, condensate switches, etc.) associated with the evaporator/fan unit 16, various electrical, refrigerant and fluid lines or any other desired purpose (e.g. inspection, repair, maintenance, etc). After the desired tasks are completed, the top of the exemplary evaporator/fan unit 16 may be engaged with the wall mounting plate 48 (as is known), and the illustrated platforms 10 may be disengaged from the plate 48 and removed. Thereafter, the bottom of the evaporator/fan unit 16 may be snapped into the snap-in tabs 50. However, this particular methodology may not be appropriate in embodiments where a mounting plate 48 is not used for engaging the platforms 10.

Referring now to FIG. 4, if desired, the support leg 20 may be selectively adjustable in length to allow the platform 10 to be easily disconnected from the wall, or any other desired purpose. In some embodiments, for example, by selectively shortening the length of the support leg 20 while the platform 10 is engage with the wall, the second end 28 of the support base 18 may be moved down (in a clockwise direction), easing disengagement of the connector 36 from the wall. Another potential reason to shorten the length of the support leg 20 may be to change the angle, or orientation, of the support base 18.

The support leg 20 may be selectively adjustable in length in any suitable manner. In this embodiment, the support leg 20 has upper and lower sections 20*a*, 20*b* in telescoping relationship. The illustrated upper section 20*a* is show inserted and telescoping within the lower section 20*b*. The respective positions of the upper and lower sections 20*a*, 20*b* may be secured with a removable pin (not shown) extendable therethrough or any other suitable mechanism(s). In other embodiments, a reverse arrangement may instead be used, wherein the lower section 20*b* telescopes within the upper section 20*a*.

Still referring to FIG. 4, in another aspect of the present disclosure, if desired, the first end 54 of the support leg 20 may be equipped with one or more buffers 114 designed to abut or rest against the wall (or one or more components disposed on the wall), such as to enhance stability and support of the platform 10 and evaporator/fan unit disposed thereupon, ease disengagement of the platform 10 from the wall or other desired purpose(s). The buffers 114 may have any suitable form, configuration and operation. In this embodiment, the buffers 114 include first and second freely rotating wheels 116, which extend outwardly from the support leg 20. The exemplary wheels 116 may assist in providing enhanced stability of the platform 10, allowing ease of pivoting of the platform 10 thereabouts when the length of the support leg 20 is adjusted or other suitable purpose. In FIG. 5, another example buffer 114 is a pad 120. If desired, the pad may be pivotably engaged with the support leg 20, such as with a bolt or pin 122, to allow it to at least partially pivot relative thereto, such as to provide flush or firm engagement of the support leg 20 with the wall (or one or more components mounted thereupon), accommodate a change in the length or position of the support leg 20 or other desired purpose.

Preferred embodiments of the present disclosure thus offer advantages over the prior art and are well adapted to carry out one or more of the objects of this disclosure. However, the present invention does not require each of the components and acts described above and is in no way limited to the above-described embodiments, variables, values, value ranges or methods of operation. Any one or more of the above components, features and processes may be employed in any suitable configuration without inclusion of other such components, features and processes. Moreover, the present invention includes additional features, capabilities, functions, methods, uses and applications that have not been specifically addressed herein but are, or will become, apparent from the description herein, the appended drawings and claims. Further, all of the value and value ranges provided herein and in the appended claims are intended to be approximate, as that term is defined herein.

The methods that may be described above or claimed herein and any other methods which may fall within the scope of the appended claims can be performed in any desired suitable order and are not necessarily limited to any sequence described herein or as may be listed in the appended claims. Further, the methods of the present invention do not necessarily require use of the particular embodiments shown and described herein, but are equally applicable with any other suitable structure, form and configuration of components.

While exemplary embodiments of the invention have been shown and described, many variations, modifications and/or changes of the system, apparatus and methods of the present invention, such as in the components, details of construction and operation, values, arrangement of parts and/or methods of use, are possible, contemplated by the patent applicant(s), within the scope of the appended claims, and may be made and used by one of ordinary skill in the art without departing from the spirit or teachings of the invention and scope of appended claims. Thus, all matter herein set forth or shown in the accompanying drawings should be interpreted as illustrative, and the scope of the disclosure and the appended claims should not be limited to the embodiments described and shown herein.

The invention claimed is:

1. Apparatus for temporarily positioning the evaporator/fan unit of a mini-split HVAC unit proximate to a wall mounting plate having a bracket and configured to engage the evaporator/fan unit, the apparatus comprising:

a removable, reusable platform including an upper, horizontally-oriented, elongated support base, said support base having a first end configured to be positioned adjacent to the wall during use of said platform and a second end configured to be spaced away from the wall during use of said platform, an upwardly facing support surface extending at least partially between said first and second ends and upon which at least part of the evaporator/fan unit is positioned and supported during use of said platform, and at least one connector disposed proximate to said first end of said support base and configured to releasably connect said platform to the wall, wherein said connector includes at least one hook to releasably engage the bracket; and an elongated support leg having first and second ends, said second end of said support leg being pivotably connected to said support base between the midpoint of said support base and said second end thereof so that said support leg is pivotable relative to said support base between at least a first, collapsed position that is useful during non-use of said platform and at least a second, extended position that is useful to support said support base and the mini-split HVAC unit positioned thereupon during use of said platform, wherein said first end of said support leg in said first collapsed position is positioned proximate to said first end of said support base and said first end of said support leg in said second extended position is spaced downwardly from said first end of said support base and engageable with the wall.

2. The apparatus of claim 1 wherein said hook is downwardly facing.

3. The apparatus of claim 1 wherein said support leg in said second, extended position is positioned angularly downwardly relative to said support base, further wherein the angle of said support leg in said second, extended position is selectively adjustable.

4. The apparatus of claim 1 wherein the support leg is configured to be selectively adjustable in length.

5. The apparatus of claim 4 wherein said support leg includes first and second releasably interconnectable telescoping sections, wherein the position of at least one said telescoping section is adjustable relative to said other telescoping section.

6. The apparatus of claim 1 further including at least one buffer disposed at said first end of said support leg.

7. The apparatus of claim 1 further including at least one spacer extending between said support base and said support leg and configured to limit the downward movement of said first end of said support leg relative to said first end of said support base.

8. The apparatus of claim 7 wherein said spacer includes at least one flexible member.

9. The apparatus of claim 7 wherein said spacer includes at least one rigid member.

* * * * *